United States Patent [19]

Jorgensen

[11] Patent Number: 4,828,340

[45] Date of Patent: May 9, 1989

[54] AUDIO/VIDEO ELECTRONIC COMPONENT CABINET

[76] Inventor: Keith J. Jorgensen, 114 South St., Stoughton, Mass. 02072

[21] Appl. No.: 234,481

[22] Filed: Aug. 19, 1988

Related U.S. Application Data

[63] Continuation of Ser. No. 26,129, Mar. 16, 1987, abandoned.

[51] Int. Cl.[4] ..... A47B 5/00

[52] U.S. Cl. ..... 312/7.1; 312/213; 312/236; 312/311

[58] Field of Search ..... 312/213, 7.1, 311, 107, 312/109, 223, 236, 138 R; 248/548, DIG. 9, DIG. 6

[56] References Cited

U.S. PATENT DOCUMENTS

| | | | |
|---|---|---|---|
| 150,219 | 4/1874 | Babcock | 312/213 |
| 1,011,112 | 12/1911 | Burlingame | 312/138 |
| 1,642,533 | 9/1927 | Beer | 312/292 X |
| 3,192,306 | 6/1965 | Skonnord | 312/213 X |
| 3,572,873 | 3/1971 | Harting | 312/7.1 X |
| 4,094,271 | 6/1978 | Louis | 248/DIG. 9 |

*Primary Examiner*—Joseph Falk

*Attorney, Agent, or Firm*—Joseph S. Iandiorio; Brian M. Dingman

[57] ABSTRACT

An audio/video electronic component cabinet includes a pair of side walls, a back wall, a front wall and a top; a plurality of component shelves extend between the side walls to the front wall but short of the back wall; a chimney formed along the back wall in the space between the ends of the shelves and the back wall receives wiring and exhausts hot air from the component; and an outlet in the top over the chimney vents the hot air from the chimney.

10 Claims, 4 Drawing Sheets

AUDIO/VIDEO ELECTRONIC COMPONENT CABINET

This is a continuation of application Ser. No. 07/026,129, filed Mar. 16, 1987, now abandoned.

FIELD OF INVENTION

This invention relates to an audio/video electronic component cabinet, and more particularly to such a cabinet which is easily customizable, includes passive cooling, and affords ready access to the components and wiring.

BACKGROUND OF INVENTION

Audio and video entertainment equipment is more and more becoming an integral and significant part of modern living. Historically one would without much contemplation find a place to put a simple radio, T.V., or stereo system. Now, the proliferation of separate components: tuner, preamplifier, power amplifier, tape deck, compact disk player, turntable, television monitor, video cassette recorder and speakers, and the necessity to properly locate and interconnect selected ones of these components, has made proper mounting cabinetry almost a necessity. Inexpensive cabinetry typically is not quality furniture and is not well designed with the thought of component care in mind: the turntable is often mounted on top or near the top where vibrations and instability are maximum; the turntable is above the rising heat from the components, and the pickup cartridge is close to the electromagnetic fields of the components. Access is poor: it is difficult to get to the backs of the components and to the interconnecting wiring; the components are behind doors which must be opened in order to operate the system. Venting of the component heat is often poor, sometimes employs active elements such as fans, and often results in obvious holes and vents which detract from whatever appeal these cabinets may have.

Better quality cabinets have improved appearance but are quite expensive and may still not be carefully designed for audio/video systems. Each piece often contemplates serving only a limited number of different components. Cutouts for the flush mounting of the front of the components involves expensive custom work. Access to components and wiring, cooling, and optimum mounting configurations for the turntable and various other components are not primary considerations.

SUMMARY OF INVENTION

It is therefore an object of this invention to provide an improved, high-quality yet extremely functional audio/video electronic component cabinet.

It is a further object of this invention to provide such a cabinet which is handsome in appearance and inexpensive.

It is a further object of this invention to provide such a cabinet which is easily and inexpensively customized for specific components.

It is a further object of this invention to provide quick and inexpensive retrofitting when audio/video components are changed.

It is a further object of this invention to provide high-volume storage capacity in an organized and easily accessible manner for the various forms of recording media that may be accumulated by an enthusiast, e.g., record albums, audio tapes, video tapes and compact disks.

It is a further object of this invention to provide for proper leveling of the cabinet so that all components sit level in the cabinet for proper function, as well as providing an appearance of a built-in cabinet installation although it is portable.

It is a further object of this invention to provide such a cabinet having easy access to the components and to the interconnecting wiring.

It is a further object of this invention to provide such a cabinet having proper mounting for the various components relative to each other.

It is a further object of this invention to provide such a cabinet which properly mounts the turntable low and stable and remote from the electromagentic fields of the components and removed from and below the rising heat from the components.

It is a further object of this invention to provide such a cabinet having unobtrusive but effective passive cooling.

The invention results from the realization that a truly functional, inexpensive custom cabinet can be made to house audio-video electronic components with adequate passive cooling by incorporating a chimney in the cabinet, that easy access can be afforded through sliding component shelves and custom cut-out removable panels in doors, and that proper location of a turntable can be accomplished in conjunction with provision of unobtrusive venting for the passive cooling.

This invention features an audio/video electronic component cabinet having a pair of side walls, a back wall, a front wall and a top. There are a plurality of component shelves extending between the side walls to the front wall but short of the back wall. A chimney is formed along the back wall in the space between the ends of the shelves and the back wall for receiving wiring and for exhausting hot air from the components. An outlet in the top over the chimney vents the hot air from the chimney.

In a preferred embodiment there is in the front wall below the component shelves an unobstructed opening to a chamber communicating with the chimney below the shelves for providing fresh air to the chimney. The chamber may include a shelf for mounting a turntable below the heat-generating components and in the lower, more stable portion of the cabinet. The turntable shelf is preferably slidably extendable out of and retractable into the chamber for accessibility in use. The component shelves may be slidably extendable out of and retractable into the cabinet for accessing the components and the wiring. The front wall may include a door proximate the component shelves for easy accessibility of the components and wiring. The door may have cutouts proximate the component shelves for flush mounting of the components in the door. The door may include a removable panel for the cutouts for easy customization of the cabinet to different components. The door may extend over the chamber and have an opening corresponding to the unobstructed opening of the chamber to permit the turntable to be moved in and out. The lower portion of the door proximate the lower end of the chamber may be independent of the door but attached to the front of the turntable shelf, so that when the door is closed it appears complete and yet the turntable can be slid out without opening the door. The cabinet may include an upper compartment above the top and the component shelves but extending back only as far as the component shelves extend in order to leave the chimney output free and yet obscure it from normal view. There may also be a lower compartment below the chamber.

DISCLOSURE OF PREFERRED EMBODIMENT

Other objects, features and advantages will occur from the following description of a preferred embodiment and the accompanying drawings, in which.

Figure 1:
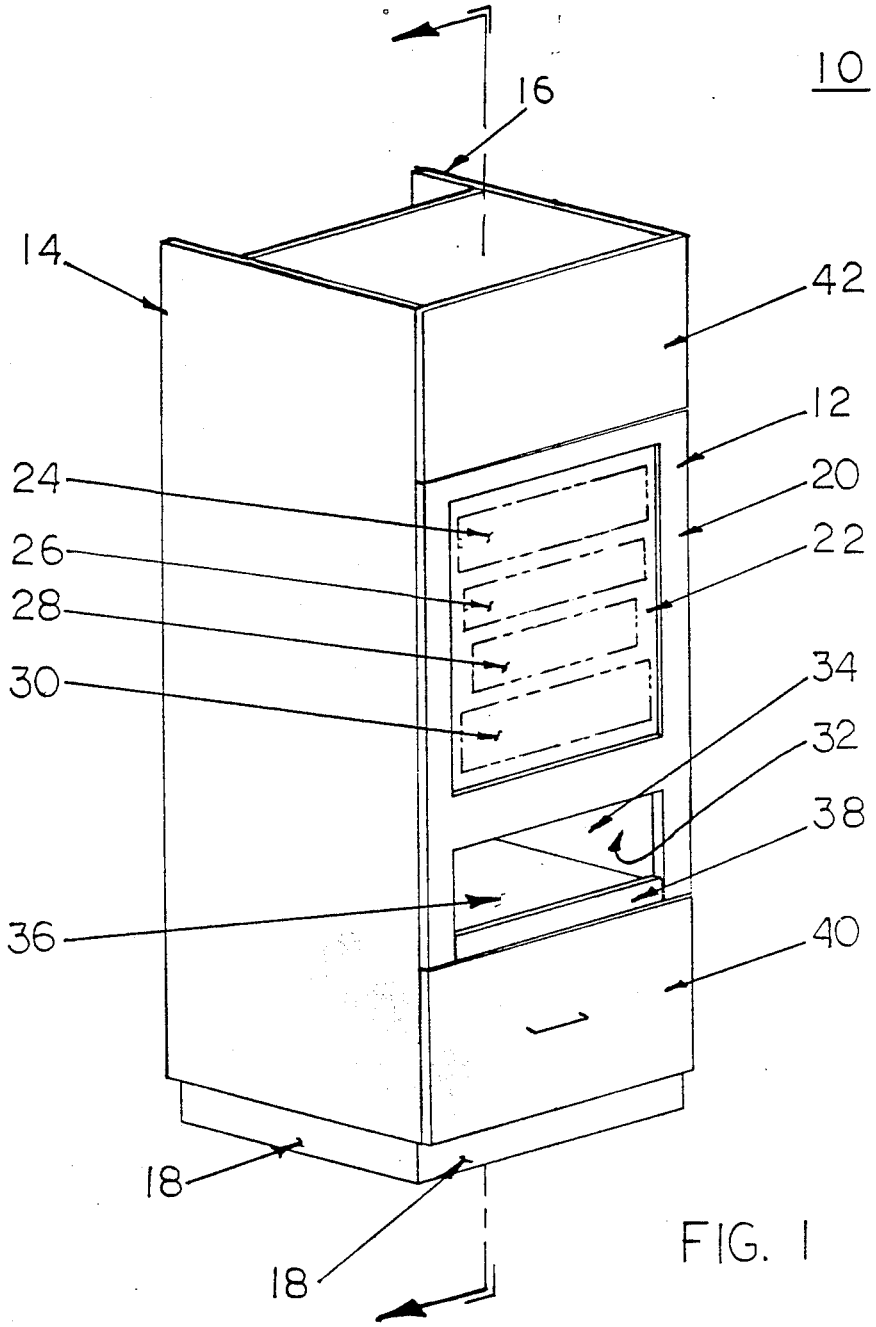
FIG. 1 is an axonometric view of an audio-video electronic component cabinet according to this invention.

There is shown in FIG. 1 an audio/video electronic component cabinet 10 according to this invention including front wall 12 and side walls 14 and 16. Three recessed kick plates 18, only two of which are shown, about the bottom of the cabinet produce the effect of a recessed pedestal. The side kick plates are cut short of the back of the cabinet to accommodate the baseboard along a wall so that the cabinet, although a free-standing structure, can assume the appearance of a completely built-in piece of furniture. Front wall 12 includes a door 20 having a recessed panel 22 showing four drawers cutouts 24, 26, 28 and 30, for accommodating flush mounting of four different audio/video electronic components. There may be more or fewer cutouts as desired. The lower portion of door 20 includes an unobstructed opening 32 to a chamber 34, which contains a shelf 36. The lower crosspiece 38 of door 20 is actually independent of the rest of door 20 and is in fact fixed to the front end of shelf 36, so that the door can be opened with the shelf 36 and crosspiece 38 still in place. Beneath chamber 34 is a lower compartment 40, and above door 20 is an upper compartment 42.

Figure 2:
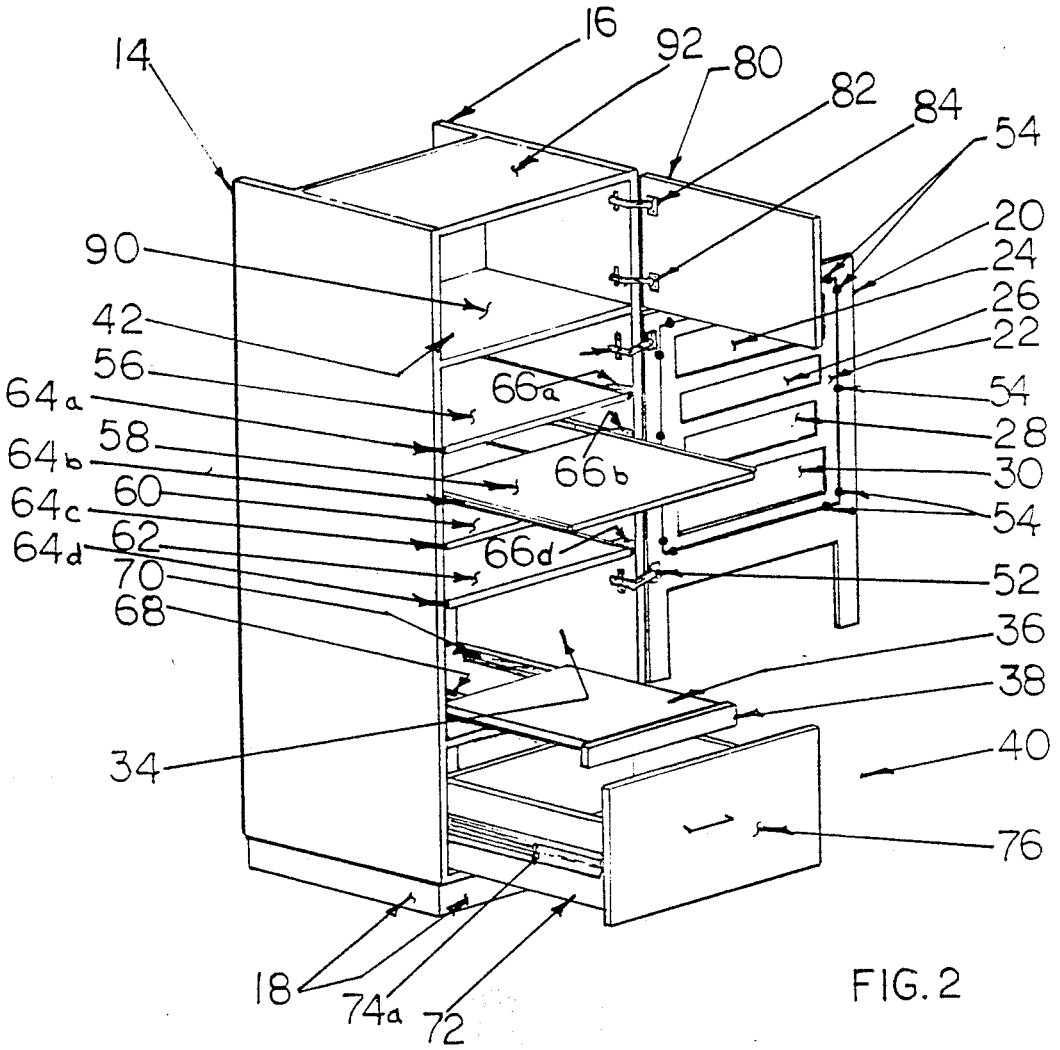
FIG. 2 is a view similar to FIG. 1 with various doors, drawers and shelves open to show the operation and interior of the cabinet.

Door 20, FIG. 2, is swingably mounted to wall 16 by means of hinges 50 and 52, and panel 22 bearing cutouts 24, 26, 28 and 30 is provisionally, not permanently, mounted by means of tabs 54 so that the panel can be easily removed for retrofitting and customization for flush mounting of specific components. Behind door 20 are a plurality of shelves 56, 58, 60 and 62, which are aligned respectively with cutouts 24, 26, 28 and 30 so that the components are correctly positioned for flush mounting with those cutouts. Since they are flush mounted, the electronic components are readily available for operation and use, and since the door is hingeably connected and can swing open it is extremely easy to get to the components for service and maintenance. In addition, accessibility is improved even further because shelves 56, 58, 60 and 62 are slidably mounted so that they can be extended out of the cabinet for service.

Each shelf is mounted to walls 14 and 16 using a pair of slide mechanisms 64*a–d*, 66*a–d*. Shelf 36 in chamber 34 is also slidably mounted on slides 68 and 70 so that a turntable mounted thereon can be easily accessed and its dust cover removed when it is desired to use it. The location of a turntable on shelf 36 in chamber 34 is advantageous for a number of reasons: it is low down in the cabinet where vibrations and instability forces are minimal; it is below the area where the electronic components reside so that it will be unaffected by the heat; it is at the same time well removed from the electromagnetic fields associated with the electronic components which could have a deleterious effect on the operation of the magnetic phonograph cartridge. The independence of crosspiece 38 from the rest of door 20 is readily understandable from FIG. 2.

Figure 3:
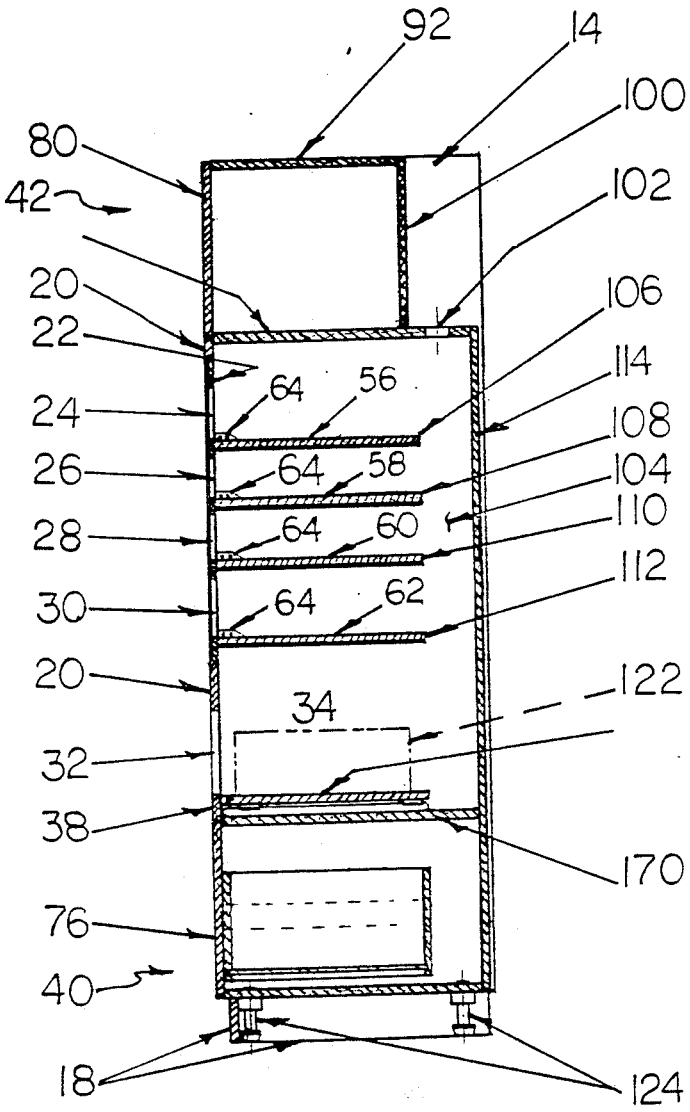
FIG. 3 is a side elevational sectional view of the cabinet of FIGS. 1 and 2.
Figure 4:
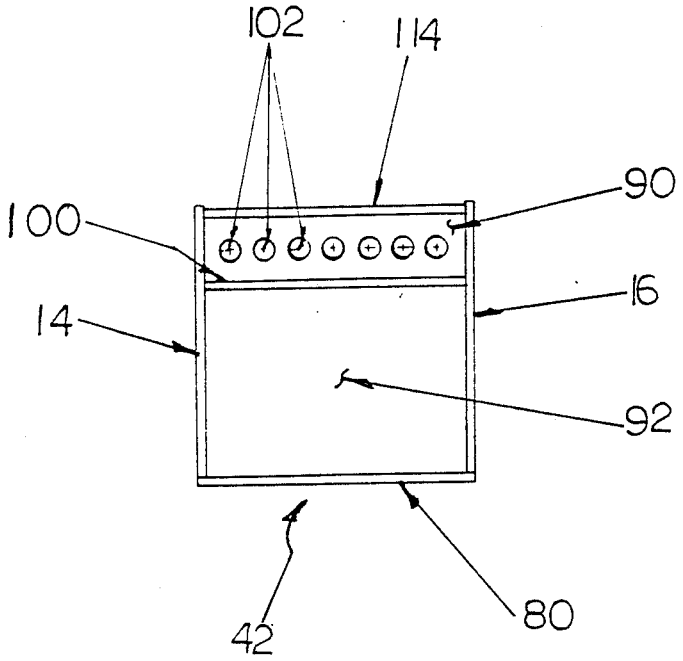
FIG. 4 is a top plan view of the cabinet of FIGS. 1, 2 and 3.

Lower compartment 40 is shown as incorporating a drawer 72 mounted on dual slide mechanisms 74*a* and 74*b*, only one of which is visible, and having a front panel 76*a* and 76*b*. Full extension slides allow complete access to the drawer for storing audio/video media. Upper compartment 42 includes door 80 mounted by means of hinges 82 and 84 to side wall 16. Hinging of doors 20 and 80 can be left or right depending on the customer's need. While top 90 which forms the base of compartment 42 extends all the way to the back of walls 14 and 16, it can be seen that the cover panel 92 at the top of compartment 42 does not reach that far. This can be seen more clearly in FIG. 3. The rear wall 100 of compartment 42 ends short of top piece 90, leaving exposed a venting area including a large hole or a number of holes 102. This is the outlet from chimney 104 formed between the ends 106, 108, 110 and 112 of the component shelves 56, 58, 60 and 62, respectively, and rear wall 114 of cabinet 10. This way, air heated by the components sitting on shelves 56–62 is drawn off and up through chimney 104 and out vent holes 102. Replacement cool air is drawn in around the space between the face of the flush-mounted components and the perimeter of cutouts 24, 26, 28 and 30. Cool air can also be drawn in freely through opening 32 in chamber 34, which communicates directly with chimney 104. A fan may be used for increasing air flow through chimney 104. Chimney 104 has its lower termination at panel 120 on which are mounted slides 68 and 70 for shelf 36. With a conventional phonograph turntable 122, shown in phantom, the operation and even the existence of chimney 104 is obscured. In this way the opening 32 performs the obvious role of permitting a conventional turntable 122, shown in phantom, to be slid out and accessed while unobtrusively providing an air inlet for the passive cooling system. In the same way the vents of outlet 102 are obscured from normal view by compartment 42. Four adjustable legs 124 are mounted within skirts 18 to provide support and easy level adjustment for the cabinet. The disposition of chimney outlet 102 is shown more clearly in FIG. 4, where it can be seen that outlet 102 includes a plurality of holes located in top piece 90 behind the rear wall 100 of compartment 42.

Although specific features of the invention are shown in some drawings and not others, this is for convenience only as each feature may be combined with any or all of the other features in accordance with the invention.

Other embodiments will occur to those skilled in the art and are within the following claims.

What is claimed is:

1. An audio/video electronic component cabinet for passively cooling electronic components comprising:

a pair of side walls, a back wall, a front wall, and a top;

as plurality of component shelves extending between said side walls to said front wall but short of said back wall;

a drafting chimney formed along said back wall in the space between the ends of said shelves and said back wall for receiving wiring and exhausting hot air for the components;

an outlet in said top over said chimney for venting the hot air from the chimney;

a plurality of openings in said front wall proximate said shelves, each said opening larger than the component on the associated shelf for providing a plurality of effective openings in said front wall proximate said components for allowing cooling air to be drafted through the openings and past the components to cool the components by displacing air heated by the components; and a further opening in said front wall below said shelves to a chamber communicating with said chimney, said chamber having a bottom formed by a further component shelf, said further opening being larger than each of said effective openings for providing a draft of fresh air into and up through said chimney to create a pressure differential between the back of said cabinet and its front to draw the cooling air through said effective openings.

2. The audio/video electronic component cabinet of claim 1 in which said further shelf extends short of said back wall and is slidably extendable out of an retractable into said chamber for accessibility in use.

3. The audio/video electronic component cabinet of claim 1 in which said component shelves are slidably extendable out of an retractable into said cabinet for accessing the components and wiring.

4. The audio/video electronic component cabinet of claim 1 in which said front wall includes a door proximate said component shelves for easy accessibility of the components and wiring.

5. The audio/video electronic component cabinet of claim 4 in which said door has cutouts proximate the component shelves forming said openings for flush mounting of the components in the door.

6. The audio/video electronic component cabinet of claim 5 in which said door includes a removable panel for said cutouts for easy customization of said cabinet to different components.

7. The audio/video electronic component cabinet of claim 1 in which said front wall includes a door proximate said component shelves for easy accessibility of the components and wiring, said door extending over said chamber and having an opening corresponding to said further opening communication with said chamber.

8. The audio/video electronic component cabinet of claim 1 in which said front wall includes a door proximate said component shelves for easy accessibility of the components and wiring, said door extending over said chamber and having an opening corresponding to said further communication with said chamber, the lower portion of said door proximate the lower end of said chamber being independent of said door and attached to the front of said further shelf to partially mask said further opening.

9. The audio/video electronic component cabinet of claim 1, said cabinet further including an upper storage compartment below said top and above said component shelves but extending back only as far as said component shelves to allow said drafting chimney to pass behind said upper storage compartment.

10. The audio/video electronic component cabinet of claim 1 said cabinet further including a lower storage compartment below said chamber.

* * * * *